US009399221B2

(12) United States Patent
Biggin

(10) Patent No.: US 9,399,221 B2
(45) Date of Patent: Jul. 26, 2016

(54) VERTICAL SPLIT BOWL LINER FOR CONE CRUSHER

(71) Applicant: Metso Minerals Industries, Inc., Waukesha, WI (US)

(72) Inventor: David Francis Biggin, Burlington, WI (US)

(73) Assignee: Metso Minerals Industries, Inc., Waukesha, WI (US)

( * ) Notice: Subject to any disclaimer, the term of this patent is extended or adjusted under 35 U.S.C. 154(b) by 473 days.

(21) Appl. No.: 13/915,167

(22) Filed: Jun. 11, 2013

(65) Prior Publication Data

US 2014/0361106 A1 Dec. 11, 2014

(51) Int. Cl.
*B02C 2/04* (2006.01)
*B02C 2/00* (2006.01)

(52) U.S. Cl.
CPC .. *B02C 2/005* (2013.01); *B02C 2/04* (2013.01)

(58) Field of Classification Search
CPC ..... B02C 2/005; B02C 2/04
USPC ..... 241/293, 294, 207–216, 299
See application file for complete search history.

(56) References Cited

U.S. PATENT DOCUMENTS 1,424,792 A * 8/1922 Ackermann ..... B02C 2/005 241/295
1,459,305 A * 6/1923 Kennedy ..... B02C 2/06 241/295
3,406,917 A 10/1968 Curtis
3,582,008 A 6/1971 Motz et al.
3,587,987 A 6/1971 Motz
3,834,633 A 9/1974 Dougall et al.
4,010,905 A 3/1977 Motz et al.
4,065,064 A 12/1977 Anthony
4,215,826 A 8/1980 Schafer
4,886,218 A 12/1989 Bradley et al.
5,080,294 A 1/1992 Dean
5,184,389 A 2/1993 Dean
5,482,218 A * 1/1996 Ha ..... B02C 4/12 241/140
5,602,945 A 2/1997 Davis
5,967,431 A 10/1999 Stafford et al.
7,451,944 B2 11/2008 Hall et al.
2012/0223171 A1 9/2012 Flath et al.

FOREIGN PATENT DOCUMENTS

CN 201552018 U 8/2010
GB 566840 A 1/1945
WO 2011/025088 A1 3/2011

OTHER PUBLICATIONS

Austrian Patent Office Search Report dated May 12, 2015.

* cited by examiner

*Primary Examiner* — Mark Rosenbaum
(74) *Attorney, Agent, or Firm* — Andrus Intellectual Property Law, LLP

(57) ABSTRACT

A bowl liner for use in a cone crusher that is comprised of a pair of bowl liner sections joined to each other to define the bowl liner. Each of the bowl liner sections includes first and second ends that engage opposite first and second vertical ends of the second bowl liner section. The first and second ends include key features that limit the axial movement of the first and second bowl liner sections relative to each other. Each of the first and second bowl liner sections further include a radial key and mating key slot to limit the radial movement between the bowl liner sections. The vertical joint between the bowl liner sections includes an inner relief that allows for manganese growth during use of the bowl liner.

12 Claims, 9 Drawing Sheets

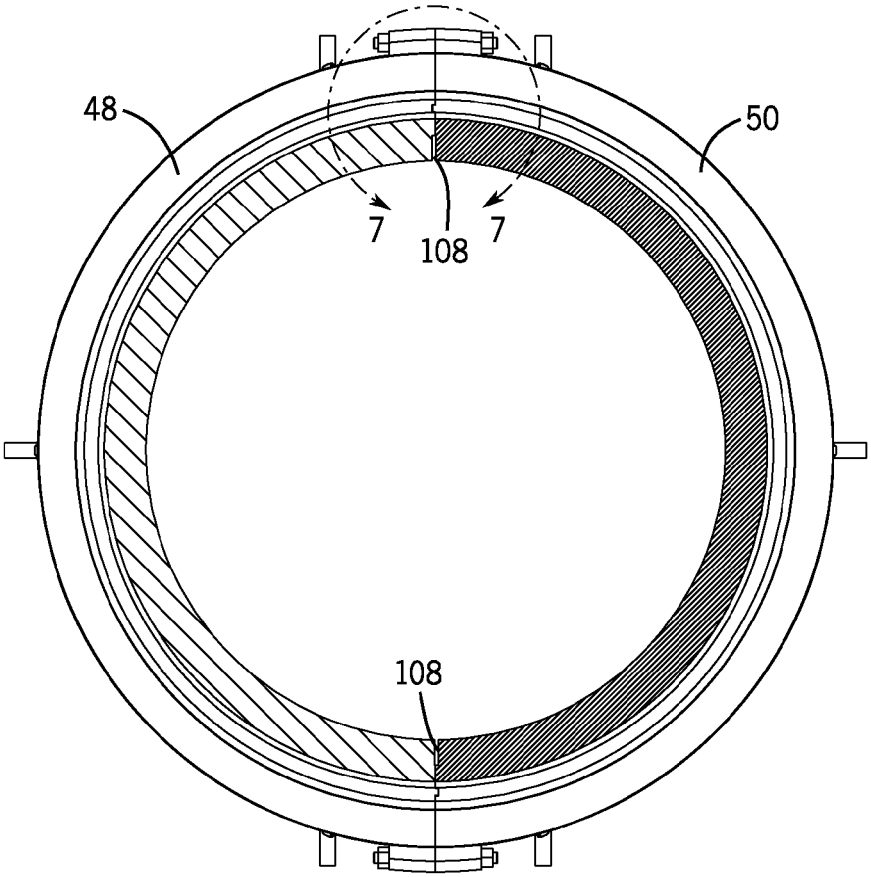
FIG. 6
FIG. 7
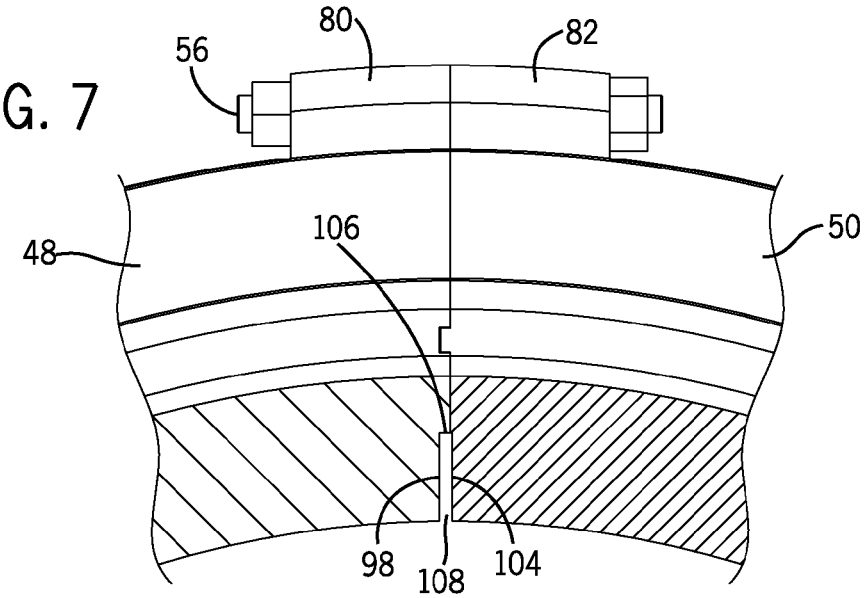

VERTICAL SPLIT BOWL LINER FOR CONE CRUSHER

BACKGROUND

The present disclosure generally relates to rock crushing equipment. More specifically, the present disclosure relates to a cone crusher including a multi-section bowl liner that is split along at least two vertical joints.

Rock crushing systems, such as those referred to as cone crushers, generally break apart rock, stone or other material in a crushing gap between a stationary element and a moving element. For example, a conical rock crusher is comprised of a head assembly including a crushing head that gyrates about a vertical axis within a stationary bowl indirectly attached to a main frame of the rock crusher. The crushing head is assembled surrounding an eccentric that rotates about a fixed shaft to impart the gyrational motion of the crushing head which crushes rock, stone or other material in a crushing gap between the crushing head and the bowl. The eccentric can be driven by a variety of power drives, such as an attached gear, driven by a pinion and countershaft assembly, and a number of mechanical power sources, such as electrical motors or combustion engines.

The exterior of the conical crushing head is covered with a protective or wear-resistant mantle that engages the material that is being crushed, such as rock, stone, ore, minerals or other substances. The bowl, which is indirectly mechanically fixed to the mainframe, is fitted with a bowl liner. The bowl liner and bowl are stationary and spaced from the crushing head. The bowl liner provides an opposing surface from the mantle for crushing the material. The material is crushed in the crushing gap between the mantle and the bowl liner.

The gyrational motion of the crushing head with respect to the stationary bowl crushes, rock, stone or other material within the crushing gap. Generally, the rock, stone or other material is fed onto a feed plate that directs the material toward the crushing gap where the material is crushed as it travels through the crushing gap. The crushed material exits the crushing chamber through the bottom of the crushing gap. The size of the crushing gap determines the maximum size of the crushed material that exits the crushing gap.

As cone crushers increase in size, shipping costs become an issue in transporting both the cone crusher and replacement parts from a manufacturing facility to a mine site. Specifically, the shipping cost dramatically increases due to the extra cost for break bulk shipping when parts do not fit into standard size vessel containers. Additionally, road transportation costs increase to obtain the required permits needed to transport oversized loads. Shipping costs are especially critical for crushing chamber wear components that are consumable items and are replaced once a maximum wear is achieved. Shipping costs may make large cone crushers cost prohibitive due to the ongoing operating costs.

SUMMARY

The present disclosure relates to a multi-section bowl liner for use in rock crushing equipment, such as a cone crusher. The multi-section bowl liner includes at least of a pair of sections joined along a pair of vertical joints and can be assembled and disassembled for shipping.

The bowl liner in accordance with the present disclosure includes a first bowl liner section and a second bowl liner section that are joined along the pair of vertical joints. The first and second bowl liner sections are mating components that each includes an inner surface and an outer surface. The inner surface of the combined bowl liner sections forms the contact surface used in the crushing operation.

Each of the first and second bowl liner sections includes a first vertical end and a second vertical end positioned on opposite sides of the each of the bowl liner sections. When the first and second bowl liner sections are mated in an assembled condition, the first end of the first bowl liner section engages the second end of the second bowl liner section. Likewise, the second end of the first bowl liner section engages the first end of the second bowl liner section in the assembled condition.

When the first and second bowl liner sections are in the assembled condition, at least a pair of upper fasteners are positioned to hold the first and second bowl liner sections in the assembled condition. In addition to the pair of upper fasteners, a pair of lower fasteners can also be used to hold the first and second bowl liner sections in the assembled condition. Alternatively, other types of devices, such as clamps, could be used to hold the bowl liner sections in the assembled condition. Once the combined bowl liner is installed in a cone crusher, the fasteners or clamps could be removed and the bowl liner would be held in the assembled condition by other components of the cone crusher, such as the bowl and wedge.

In one embodiment of the disclosure, the first and second ends each include a portion of a key feature. The key feature allows the first and second bowl liner sections to interact with each other to limit the relative movement between the first and second bowl liner sections in the assembled condition. In one embodiment of the disclosure, the first end of each bowl liner section includes a first series of key slots while the second end includes a series of protruding axial keys. When the first and second bowl liner sections are brought together in the assembled condition, the series of axial keys on the second end mates and meshes with the key slots formed on the first end to restrict the axial movement of the first and second bowl liner sections when in the assembled condition.

In addition to the axial keys, the first and second bowl liner sections each include a key slot formed in a first upper fastener boss and a radial key formed on a second upper fastener boss. When the first and second bowl liner sections are brought together in the assembled condition, the key slot receives the radial key to help limit the radial movement between the bowl liner sections when in the assembled condition.

When the first and second bowl liner sections are brought together in the assembled condition, the first end includes a portion that is slightly recessed from the second end to define an inner wear relief area. The inner relief area allows for manganese growth during use of the bowl liner. In addition, the inner relief allows for monitoring of the wear on the bowl liner.

The bowl liner of the present disclosure can be used with a cone crusher or other types of equipment used to crush rock. During initial manufacture, the bowl liner sections are positioned adjacent to each other in the assembled condition and a lower tapered surface of the bowl liner is machined to the desired tolerances. Once the lower tapered surface of the bowl liner and any other required surface has been machined, the bowl liner is separated into the two bowl liner sections for shipment.

After shipment to a mine site, the first and second bowl liner sections are reassembled and installed on the crushing equipment. In this manner, the bowl liner can be broken down into multiple pieces for shipment and reassembled prior to installation in a cone crusher.

BRIEF DESCRIPTION OF THE DRAWINGS

The drawings illustrate the best mode presently contemplated of carrying out the disclosure. In the drawings:

FIG. 6 is a section view taken along line 6-6 of FIG. 5;

FIG. 7 is a magnified view taken along line 7-7 of FIG. 6;

DETAILED DESCRIPTION

Figure 1:
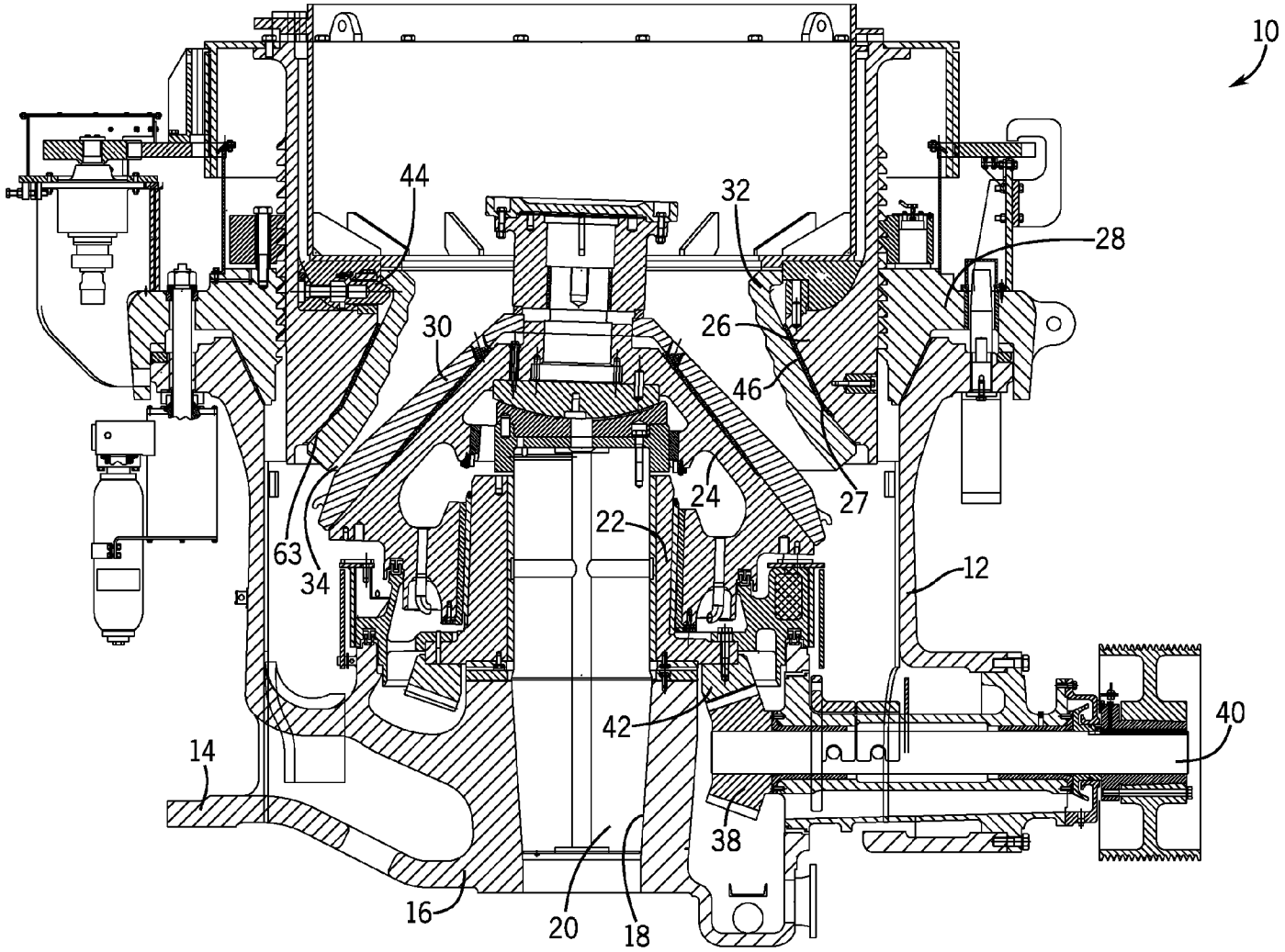
FIG. 1 is a section view of a cone crusher incorporating the vertical split bowl liner of the present disclosure.

FIG. 1 illustrates a section view of a cone crusher 10 that is operable to crush material, such as rock, stone, ore, mineral or other substances. The cone crusher 10 includes a mainframe 12 having a base 14. The cone crusher 10 can be any size rock crusher or include any type of crusher head. Base 14 rests upon a platform-like foundation that can include concrete piers (not shown), a foundation block, a platform or other supporting member. A central hub 16 of the mainframe 12 includes an upwardly diverging vertical bore or tapered bore 18. The bore 18 is adapted to receive a main shaft 20. The main shaft 20 is held stationary in the bore 18 with respect to the central hub 16 of the frame 12.

The main shaft 20 supports an eccentric 22 that surrounds the main shaft 20 and is coupled to a head assembly 24. The eccentric 22 rotates about the stationary main shaft 20, thereby causing the head assembly 24 to gyrate within the cone crusher 10. Gyration of the head assembly 24 within a bowl 26 that is indirectly fixed to an adjustment ring 28 that is supported by the mainframe 12 and allows rock, stone, ore, minerals or other materials to be crushed between a mantle 30 and a bowl liner 32 constructed in accordance with the present disclosure. The gyrational motion of the head assembly 24 crushes rock in a crushing gap 34 and the force of gravity causes additional material to move toward the crushing gap 34. The bowl liner 32 is held against the bowl 26 by a wedge 44 and the mantle 30 is attached to the head assembly 24. The head assembly 24 forces the mantle 30 toward the bowl liner 32 to create the rock crushing force within the crushing gap 34.

As can be understood in FIG. 1, when the cone crusher 10 is operating, drive shaft 40 rotates the eccentric 22 through the interaction between the pinion 38 and the gear 42. Since the outside diameter of the eccentric 22 is offset from the inside diameter, the rotation of the eccentric 22 creates the gyrational movement of the head assembly within the stationary bowl 26. The gyrational movement of the head assembly 24 changes the size of the crushing gap 34 which allows the material to be crushed to enter into the crushing gap. Further rotation of the eccentric 22 creates the crushing force within the crushing gap 34 to reduce the size of particles being crushed by the cone crusher 10. The cone crusher 10 can be one of many different types of cone crushers available from various manufacturers, such as Metso Minerals of Waukesha, Wis. As an example, the cone crusher 10 shown in FIG. 1 can be an MP® series rock crusher, such as the MP®1000 available from Metso Minerals. However, different types of cone crushers could be utilized while operating within the scope of the present disclosure.

As illustrated in FIG. 1, the bowl liner 32 is supported relative to the bowl 26 through the wedge 44. The wedge 44 is positioned between the bowl 26 and the bowl liner 32 to hold the bowl liner in the position shown. A backing 46 is positioned between a portion of the outer surface of the bowl liner 32 and a contact surface of the bowl 26.

During operation of the cone crasher 10, material is crushed by the rotating movement of the head assembly 24 in the crushing gap 34 formed between the outer surface of the mantle 30 and the bowl liner 32. Both the bowl liner 32 and the mantle 30 are designed as replaceable equipment such that the cone crusher can be refurbished upon wear.

Figure 2:
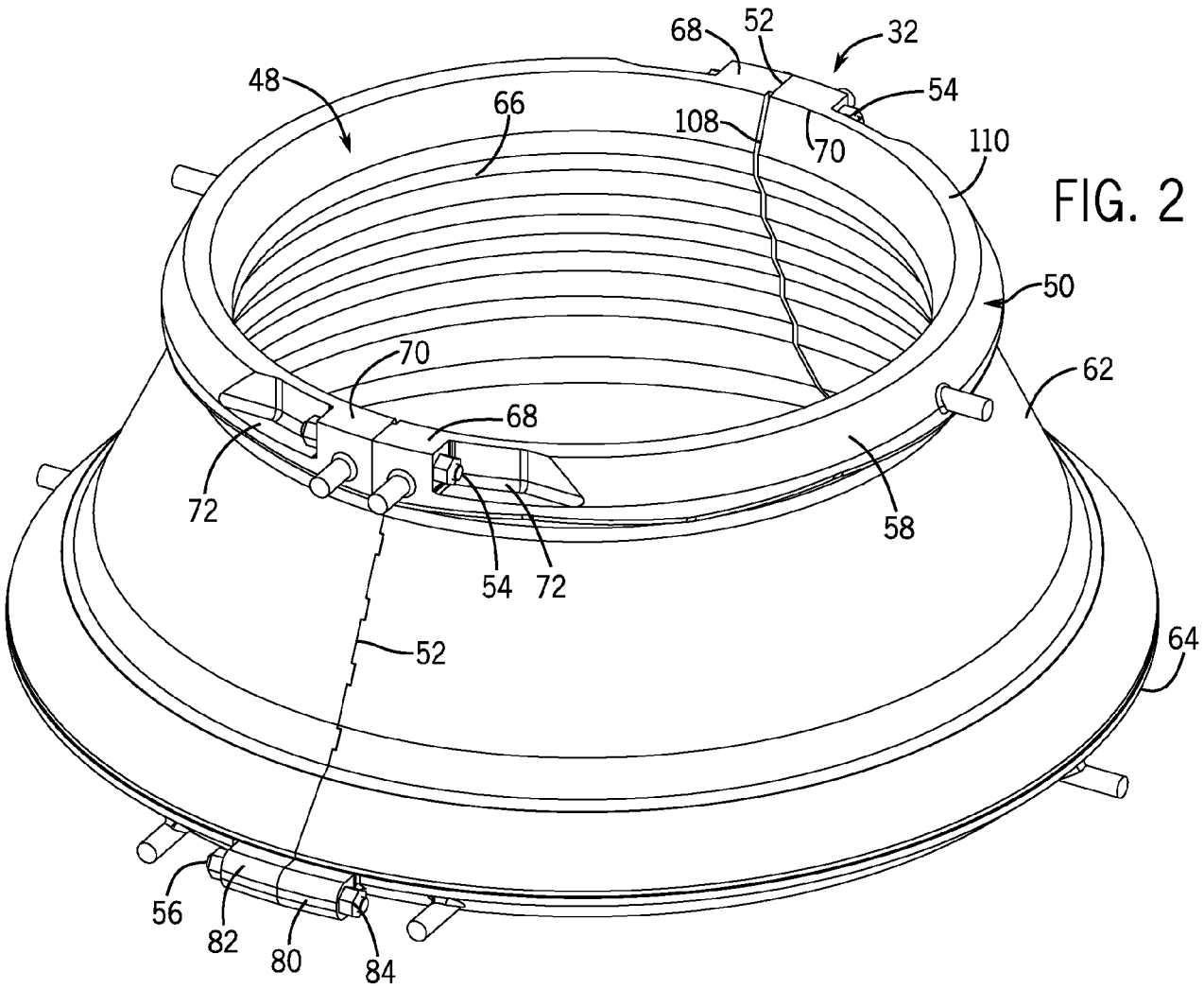
FIG. 2 is a top isometric view of the vertical split bowl liner in its assembled condition.
Figure 3:
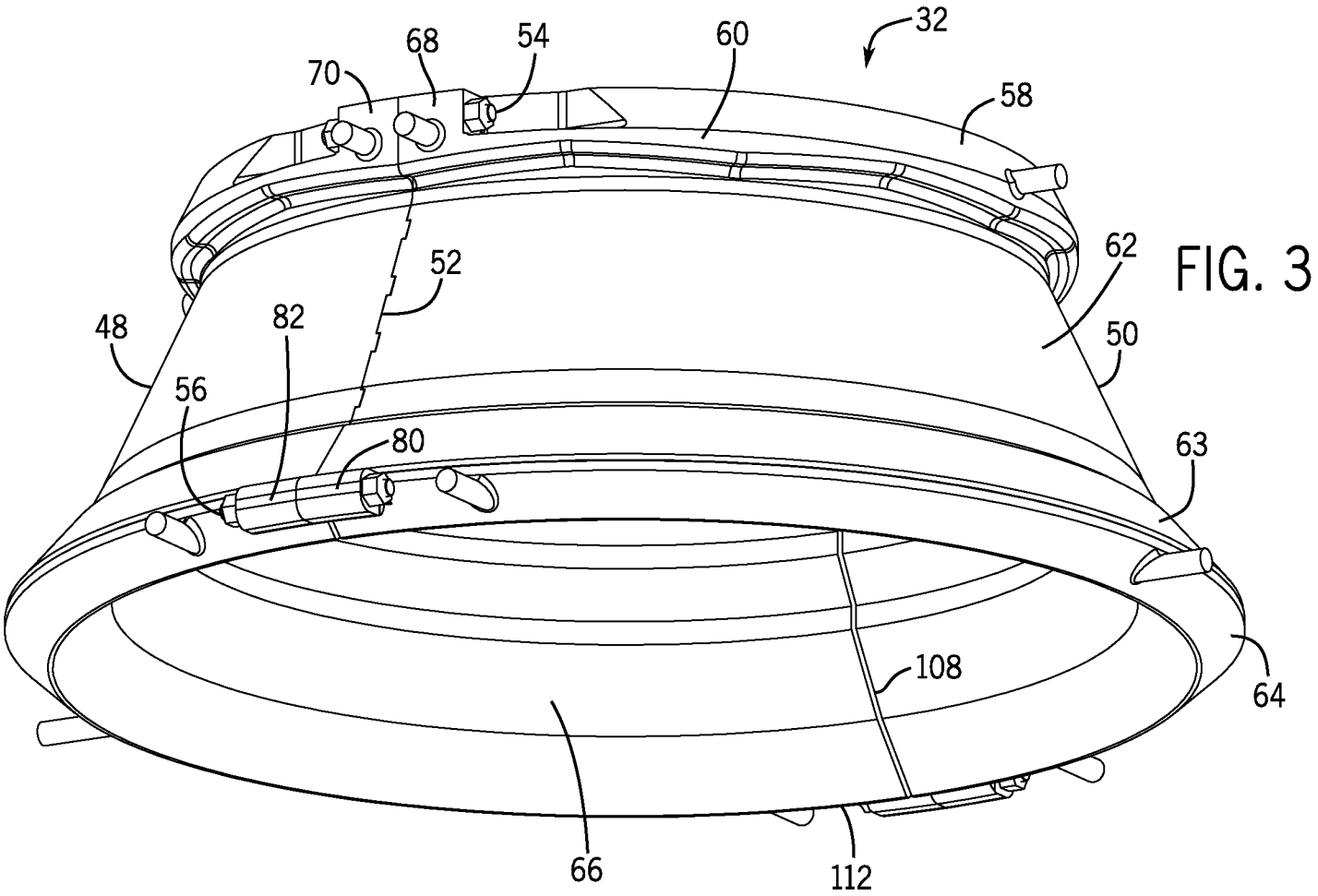
FIG. 3 is a bottom isometric view of the vertical split bowl liner in its assembled condition.
Figure 4:
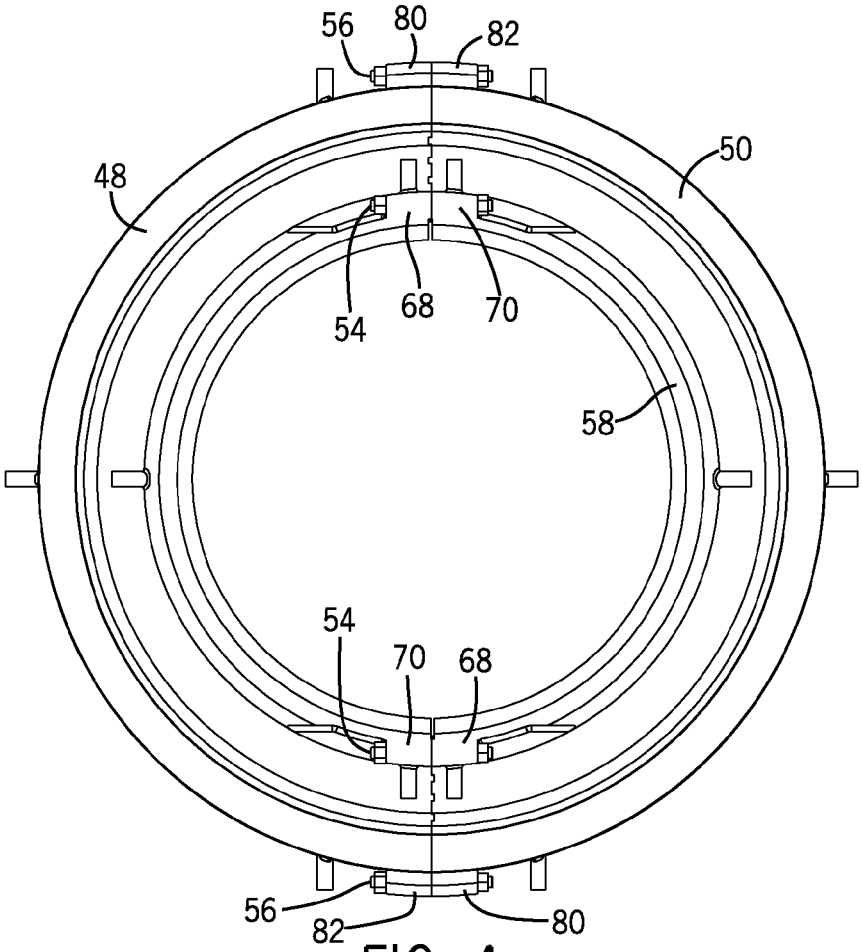
FIG. 4 is a top view of the vertical split bowl liner in its assembled condition.

FIGS. 2 and 3 illustrate a vertically split bowl liner 32 constructed in accordance with the present disclosure. The bowl liner 32 includes a first bowl liner section 48 and a second bowl liner section 50 that are joined together to form the complete bowl liner 32. In the embodiment shown, the first and second bowl liner sections 48, 50 are identical components that are mated to each other to form the bowl liner 32. However, it is contemplated that the first and second bowl liner sections 48, 50 could be non-identical components that are designed to mate with each other to create the complete bowl liner 32.

When the first and second bowl liner sections 48, 50 are joined as shown in FIGS. 2 and 3, a pair of vertical joints 52 are formed between the first and second bowl liner sections. The first and second bowl liner sections 48, 50 can be joined to each other through use of a pair of upper connectors 54 and a pair of lower connectors 56. Although upper and lower connectors 54, 56 are shown in the illustrated embodiment, it should be understood that other types of connectors, such as clamps, could be utilized while operating within the scope of the present disclosure. The use of either clamps or connectors allow the two bowl liner sections 48, 50 to be held in the assembled condition and the entire bowl liner 32 machined prior to shipment and subsequent installation. When the first and second bowl liner sections 48, 50 are joined together in the assembled condition shown in FIGS. 2 and 3, the bowl liner 32 functions as a one-piece structure even though the bowl liner 32 is formed from two joined, separate sections. By breaking the bowl liner 32 into multiple sections, each of the bowl liner sections 48, 50 can be shipped in a standard shipping container, which reduces the transportation cost of the bowl liner 32.

As illustrated in FIG. 3, the bowl liner 32 includes an upper flange 58 that is engaged by the wedge 44 shown in FIG. 1 to hold the bowl liner 32 in position relative to the stationary bowl 26. The upper flange 58 includes a helical ramp 60 that interacts with the wedge 44 to hold the bowl liner in place relative to the stationary bowl.

As illustrated in FIGS. 2 and 3, the bowl liner 32 defines an outer surface 62 that extends between the upper flange 58 and a lower lip 64. A portion of the outer surface 62 receives the backing 46 when the bowl liner 32 is mounted to the stationary bowl 26, as shown in FIG. 1. The outer surface 62 further includes a contacting taper 63 that is precisely machined on both of the bowl liner sections 48, 50. The contacting taper 63 engages a machine taper 27 formed as part of the bowl 26, as shown in FIG. 1. As illustrated in FIG. 1, the backing 46 extends along only a portion of the outer surface of the bowl liner 32 and stops before the contact area between the contacting taper 63 and the machine taper 27. The contacting taper 63 formed on the bowl liner 32 thus engages the bowl taper 27 in a metal-to-metal contacting support.

When the bowl liner 32 is installed as shown in FIG. 1, the wedges 44 hold the bowl liner 32 in place by pulling the bowl liner 32 upward and thus seating the contacting taper 63 in metal-to-metal contact with the taper 27 formed on the bowl 26.

During operation of the cone crusher, the crushing forces created against the bowl liner 32 exert a rotational force on the bowl liner 32 relative to the stationary bowl 26. The rotational forces created against the bowl liner 32 cause the bowl liner 32 to rotate relative to the stationary wedges 44, thereby causing the wedges 44 to ride up the helical ramps 60 shown in FIG. 3. The interaction between the helical ramps 60 and the wedges 44 puts the bowl liner sections 48, 50 into axial tension. The helical ramps 60 urge the bowl liner 32 upward, which increases the contact force between the contacting taper 63 formed on the bowl liner 32 and the taper 27 formed on the bowl 26. The shape of the contacting taper 63 and the taper 27 causes circumferential compression between the bowl liner sections, thereby causing the two bowl liner sections 48, 50 to be circumferentially compressed into contact with each other, further causing the two halves to act as one.

The bowl liner 32 includes an inner surface 66 that contacts the material being crushed and thus is subject to wear during continued use of the cone crusher. Both the outer surface 62 and the inner surface 66 are defined by the pair of mated first and second bowl liner sections 48, 50, as illustrated.

As further illustrated in FIGS. 2 and 3, each of the bowl liner sections includes a first upper fastener boss 68 and a second upper fastener boss 70 that are formed on opposite sides of the bowl liner section. Since the first and second bowl liner sections 48, 50 are identical components in the embodiment shown, the first upper fastener boss 68 of the first bowl liner section 48 mates with the second upper fastener boss 70 of the second bowl liner section 50 while the second upper fastener boss 70 mates with the first upper fastener boss 68 on the opposite side of the mated first and second bowl liner sections. The first and second upper fastener bosses 68, 70 each are positioned adjacent to a recessed area 72 formed in the upper flange 58. The recessed areas 72 provide access to the upper connectors 54.

Figure 12:
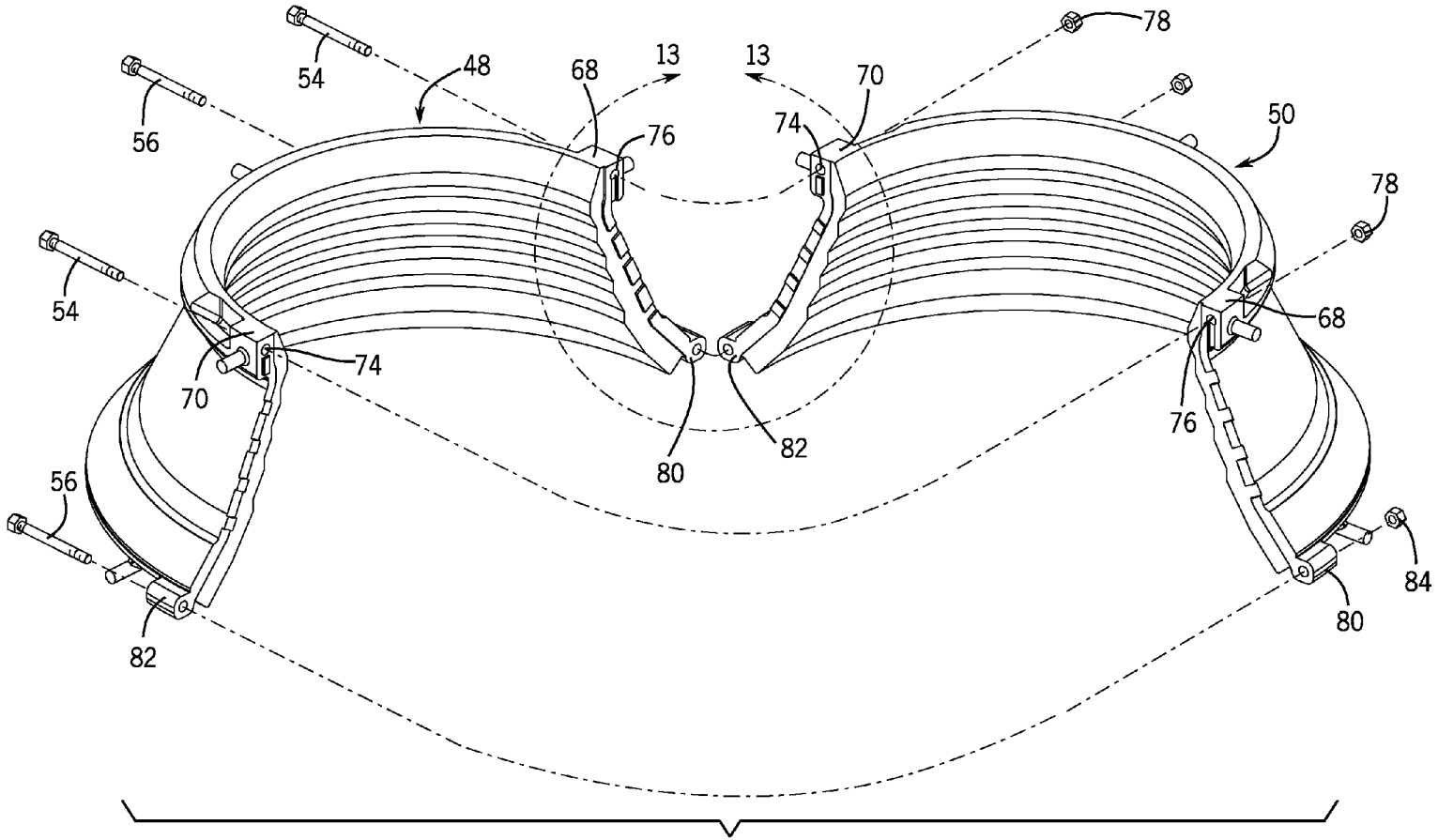
FIG. 12 is an exploded view showing the first and second bowl liner sections in their disassembled condition.

Specifically, as illustrated in FIG. 12, each of the upper connectors 54 extends through an access opening 74 in the second upper fastener boss 70 and a corresponding access opening 76 in the first upper fastener boss 68. The opposite end of the connector 54 receives a nut 78 to securely attach the two sections 48, 50, as shown in FIG. 2.

In addition to the upper bosses discussed, each of the first and second bowl liner sections 48, 50 includes a first lower fastener boss 80 and a second lower fastener boss 82. The first and second lower fastener bosses 80, 82 receive one of the lower connectors 56. When the lower connector 56 is inserted into the aligned first and second lower fastener bosses of the first and second bowl liner sections 48, 50, the lower connector 56 receives a nut 84 to further secure the first and second bowl liner sections 48 50 into the one-piece construction shown in FIG. 2.

Although the upper and lower connectors are shown in the Figures, it is contemplated that the connectors could be removed once the bowl liner 32 is installed. As described above, the wedge 44 exerts and upward force on the bowl liner 32, thereby causing the contacting taper 63 to engage the machine taper 27. The force created by such contact compresses the bowl liner 32, thereby eliminating the need for the fasteners. However, the fasteners, or some other type of connector, are needed to hold the bowl liner 32 in the assembled condition during machining and prior to installation.

Figure 8:
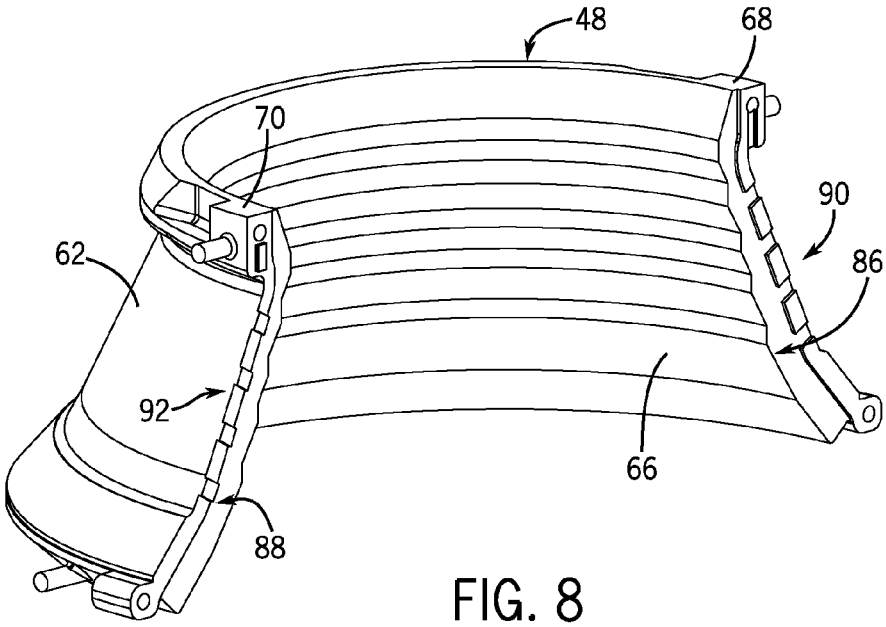
FIG. 8 is an isometric view of one of the bowl liner sections in its disassembled condition.
Figure 9:
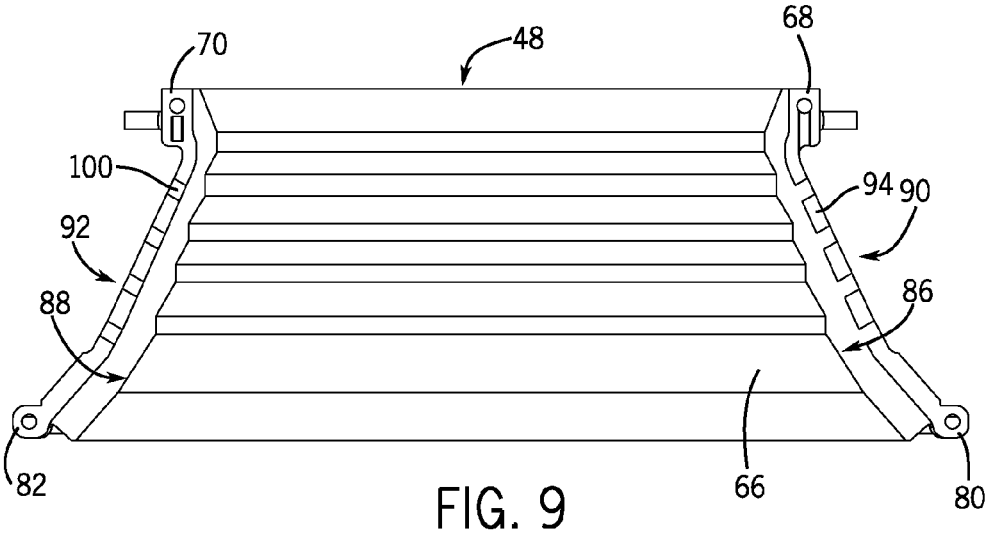
FIG. 9 is a front view of the bowl liner section.
Figure 10:
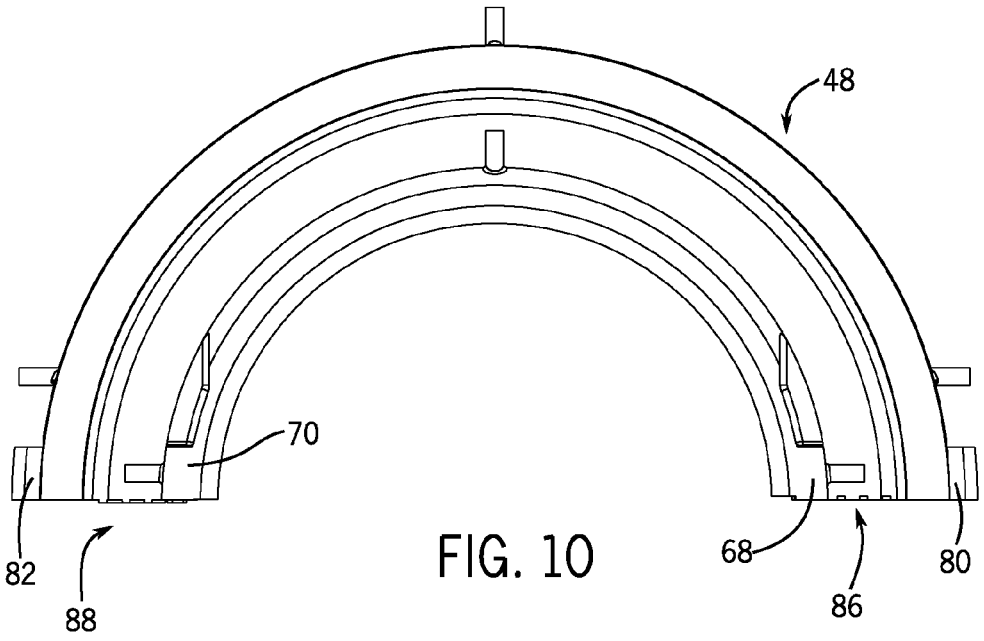
FIG. 10 is a top view of the bowl liner section.
Figure 11:
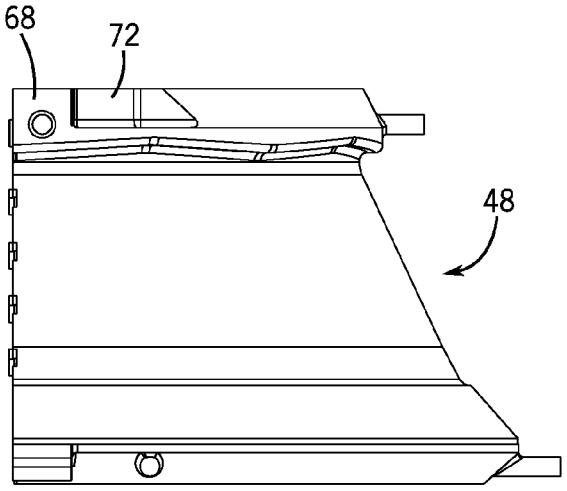
FIG. 11 is a side view of the bowl liner section.

FIGS. 8 and 9 illustrate the first bowl liner section 48. As indicated above in the illustrated embodiment, the second bowl liner section 50 (not shown) is identical to the first bowl liner section 48 and the details of the second bowl liner section 50 thus correspond to those to be described below. In the embodiment shown in FIG. 8, the first bowl liner section 48 defines one-half of the combined bowl liner. However, it should be understood that in the illustrated embodiment each of the bowl liner sections will have the same appearance and combine to form the entire bowl liner.

The bowl liner section 48 defines a first end 86 and a second end 88 that each define a transition between the inner surface 66 and the outer surface 62. The first and second ends 86, 88 interact with the corresponding ends on the second bowl liner section 50 when the bowl liner is assembled, as shown in FIG. 2. Since the first and second bowl liner sections 48, 50 are identical, the first and second ends 86, 88 are designed to interact with each other. The first end 86 includes a first portion 90 of a key feature while the second end 88 includes a second portion 92 of the same key feature.

Figure 13:
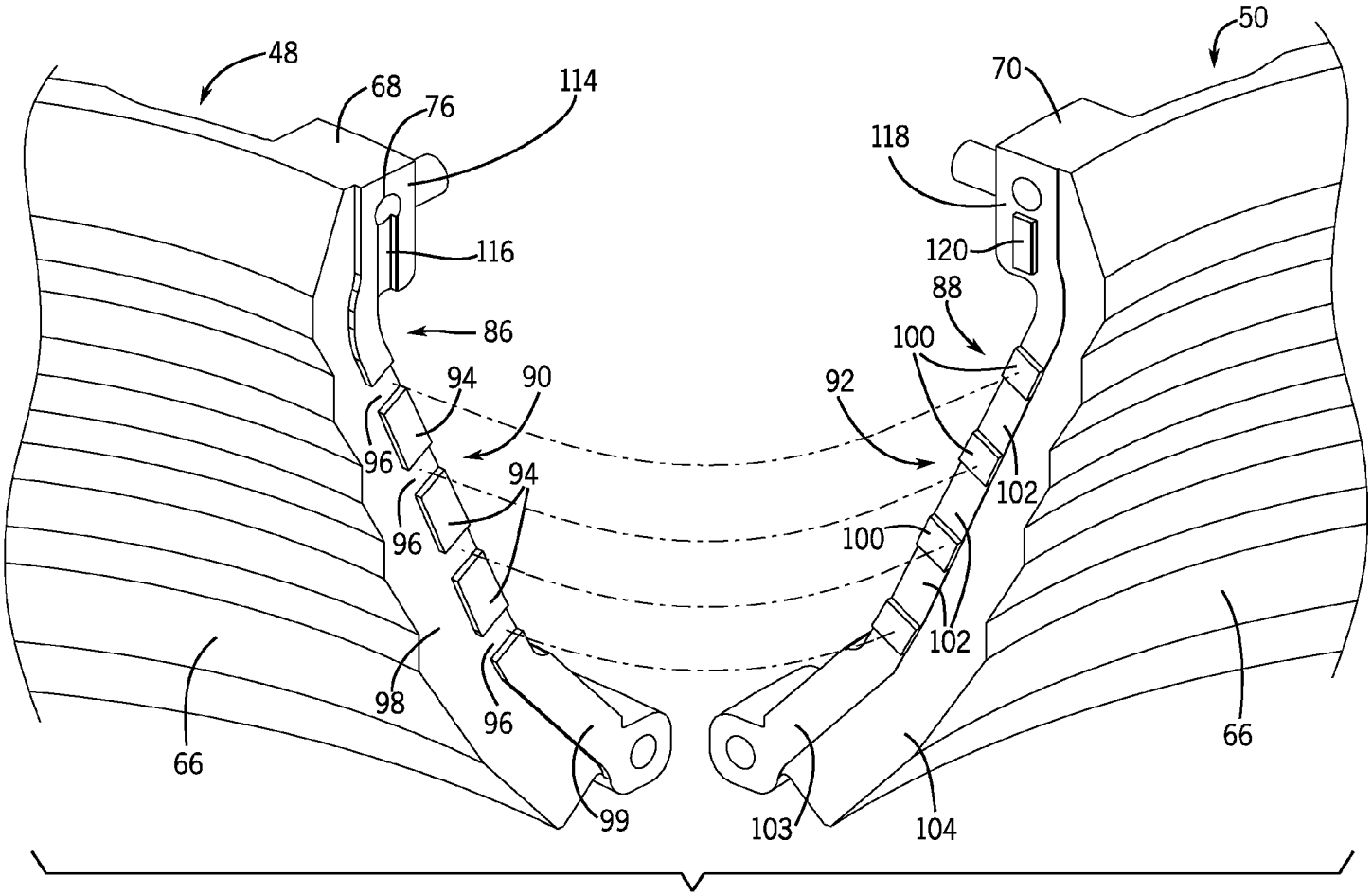
FIG. 13 is a magnified view taken along line 13-13 of FIG. 12.

As best illustrated in FIG. 13, the first portion 90 of the key feature includes a series of protruding bosses 94 that are each separated by a key slot 96. The width of the bosses 94 is less than the total width of the first end 86 such that a generally flat recessed surface 98 is formed between the series of bosses 94 and the inner surface 66. The surface 98 is generally flush with the key slots 96 such that each of the bosses 94 protrudes from the surface 98.

The first end 86 further includes lower contact surface 99 that is in the same plane as the outermost surface of the series of bosses 94 as well as the contact surface 114 of the first upper fastener boss 68. The common plane that extends through the lower contact surface 99, the lower contact surface 114 as well as the faces of the series of bosses 94 defines an engagement surface for the first end 86.

Figure 5:
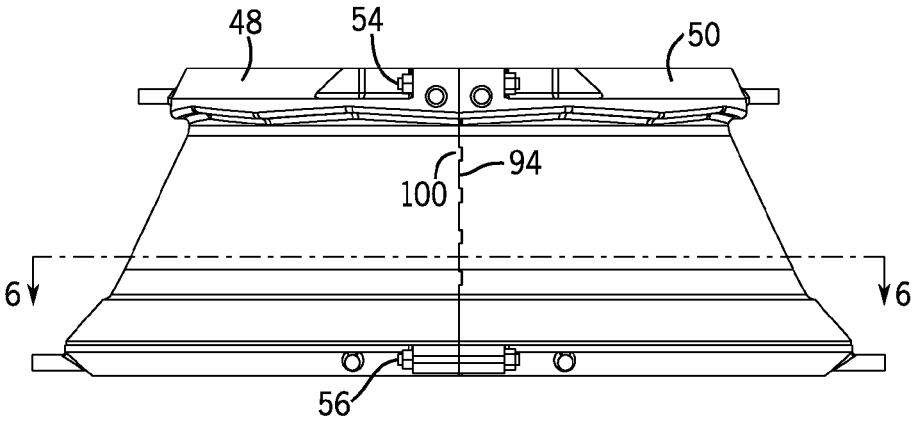
FIG. 5 is a side view of the vertical split bowl liner in its assembled condition.

The second end 88 includes the second portion 92 of the axial key feature. The second portion of the axial key feature includes a series of axial keys 100 that are each spaced by an open slot 102. The length of the open slots 102 corresponds to the length of the bosses 94 while the length of the axial keys 100 corresponds to the length of the key slots 96. In this manner, when the first and second bowl liner sections 48, 50 are mated as shown in FIG. 5, the interaction between the axial keys 100 and the key slots 96 restrict the axial movement of the first and second bowl liner sections 48, 50.

Referring back to FIG. 13, the second end 88 includes a lower contact surface 103 that is in the same general plane as the open slots 102 and the upper contact surface 118. When the first and second bowl liner sections 48, 50 are mated, the lower contact surface 99 on the first end 86 contacts and engages the lower contact surface 103 on the second end 88. Likewise, the upper contact surface 114 on the first end 86 is in physical contact with the upper contact surface 118 on the second end 88. At the same time, the faces of the series of bosses 94 contact the inner surface of the open slots 102. In the embodiment illustrated, each of the axial keys 100 protrude from the open slots 102 by a height that is less then the depth of the key slots 96 formed on the first end 86. Thus, each of the axial keys 100 does not bottom out against the surface 98 within the key slot 96.

As shown in FIG. 13, a recessed surface 104 is formed on the second end 88. The surface 104 is slightly recessed from the plane that defines the lower contact surface 103 and each of the open slots 102. Thus, when the pair of bowl liner sections are brought together in the assembled condition, a gap is created between the recessed surface 104 and the surface 98.

FIGS. 6 and 7 best illustrate an inner relief 108 that is formed between the recessed surface 104 formed on the second end and the surface 98 formed on the first end of the opposite bowl liner section. The inner relief 108 extends from the top edge 110 to the bottom edge 112 of the bowl liner, as best illustrated in FIGS. 2 and 3. The inner relief 108 is formed along the inner surface 66 of both of the vertical joints 52 formed between the mating first and second bowl liner sections 48, 50.

As can be understood in FIG. 7, the first and second bowl liner sections 48, 50 contact each other over less than the outer half of the thickness of the bowl liner. This feature limits the contact to the non-wearing back of the bowl liner and creates the inner relief 108 that acts as a relief against manganese growth at the surface. The inner relief 108 allows for the monitoring of the manganese growth at the interface between the first and second bowl liner sections 48, 50.

Referring to FIG. 13, the first upper fastener boss 68 includes the upper contact surface 114. The contact surface 114 is in the same plane as the outer surface defined by each of the bosses 94. The first upper fastener boss 68 includes a recessed key slot 116 extending below the access opening 76. The key slot 116 is recessed from the contact surface 114 as clearly illustrated.

The opposite side of each of the bowl liner sections includes the second upper fastener boss 70, which also defines the upper contact surface 118. The upper contact surface 118 is in the same plane as the surface that defines the open slots 102, as illustrated. The second upper fastener boss 70 includes a radial key 120 that protrudes away from the contact surface 118. The radial key 120 is sized to fit within the key slot 116 when the first and second ends 86, 88 are positioned adjacent to each other. When joined, the contact surface 118 engages the contact surface 114 and the radial key 120 is received within the key slot 116. The interaction between the radial key 120 and the key slot 116 at each of the two vertical joints helps to limit the radial movement between the bowl liner sections when in an assembled condition. As illustrated in FIG. 1, the upper most edge of the bowl liner 32 extends above the bowl 26 and thus is not supported by the bowl 26. The interaction between the radial key 120 and the key slot 116 aids in limiting the amount of radial movement between the bowl liner sections in this upper portion of the bowl liner 32.

When the first and second bowl liner sections are assembled as shown in FIG. 2, the interaction between the axial key 120 and the key slot 116 prevents and restricts the radial movement between the two bowl liner sections 48, 50. At the same time, the interaction between the axial keys 100 and key slots 96 limits the axial movement of the bowl liner sections relative to each other. The two types of key systems limit the shear forces on the pair of upper connectors 54 and the pair of lower connectors 56.

During the initial construction of the bowl liner 32 of the present disclosure, each of the bowl liner sections 48, 50 are cast separately. As previously described, the first and second bowl liner sections 48, 50 can have an identical appearance to each other and thus can be made from the same casting molds. Alternatively, the two bowl liner sections 48, 50 can be created as separate components that include mating features that allow the two bowl liner sections 48, 50 to be joined to each other to define a complete bowl liner. The user of the pair of identical bowl liner sections reduces the number of different components needed to create the bowl liner. However, different bowl liner sections are contemplated as being within the scope of the present disclosure.

On the first and second bowl liner sections are cast, the components are placed adjacent to each other and joined through the use of the pair of upper connectors 54 and lower connectors 56. After the bowl liner has been assembled, the entire bowl liner can be machined to the desired tolerances offsite from the location of the cone crusher. Specifically, when the bowl liner sections are joined to each other, the contacting taper 63 is machined around the entire bowl liner. Once the machining process has been completed, the two bowl liner sections 48, 50 are disassembled for shipping. Since the bowl liner 32 may have a large outer diameter, such as up to 13 feet, shipping the assembled bowl liner or a one-piece bowl liner is both costly and difficult. Separating the bowl liner into two separate bowl liner sections 48, 50 reduces the transportation costs and increases the number of foundries that can cast the bowl liner sections.

Once the pair of bowl liner sections arrives at the location of the cone crusher, the bowl liner sections are reassembled and installed on the cone crusher.

This written description uses examples to disclose the invention, including the best mode, and also to enable any person skilled in the art to make and use the invention. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

I claim:

1. A bowl liner for use in a cone crusher, comprising:

a first bowl liner section having an inner surface, an outer surface, a first end extending between the inner and outer surface and a second end extending between the inner and outer surface;

a second bowl liner section having an inner surface, an outer surface, a first end extending between the inner and outer surface and a second end extending between the inner and outer surface, wherein the first end of the second bowl liner is in contact with the second end of the first bowl liner along a first vertical joint and the second end of the second bowl liner is in contact with the first end of the first bowl liner along a second vertical joint when the first and second bowl liners are in an assembled condition to define the bowl liner, wherein the first end of each of the first and second bowl liner sections includes a series of key slots integrally formed with the bowl liner section and the second end of each of the first and second bowl liner sections includes a series of protruding axial keys integrally formed with the bowl liner section, wherein the series of key slots interact with the series of protruding axial keys when the first and second bowl liner sections are in the assembled condition to restrict axial movement of the first and second bowl liner sections relative to each other.

2. The bowl liner of claim 1 further comprising a pair of upper fasteners each positioned to hold the first and second bowl liner sections in the assembled condition.

3. A bowl liner for use in a cone crusher, comprising:

a first bowl liner section having an inner surface, an outer surface, a first end extending between the inner and outer surface and a second end extending between the inner and outer surface;

a second bowl liner section having an inner surface, an outer surface, a first end extending between the inner and outer surface and a second end extending between the inner and outer surface, wherein the first end of the second bowl liner is in contact with the second end of the first bowl liner along a first vertical joint and the second end of the second bowl liner is in contact with the first end of the first bowl liner along a second vertical joint when the first and second bowl liners are in an assembled condition to define the bowl liner, wherein each of the first and second bowl liner sections includes a first upper fastener boss having a first contact surface and a second upper fastener boss having a second contact surface, wherein a pair of upper fasteners extend through the first and second upper fastener bosses to hold the first and second bowl liner sections in the assembled condition.

4. The bowl liner of claim 3 wherein the first contact surface of the first upper fastener boss includes a key slot and the second contact surface of the second upper fastener boss includes a radial key, wherein the key slot of the first bowl liner section receives the radial key of the second bowl liner section and the key slot of the second bowl liner section receives the radial key of the first bowl liner section when the first and second bowl liner sections are in the assembled condition.

5. The bowl liner of claim 4 wherein the key slots and radial keys limit the relative radial movement between the first and second bowl liner sections when the first and second bowl liner sections are in the assembled condition.

6. The bowl liner of claim 3 further comprising a first and a second lower fastener boss formed on each of the first and second bowl liner sections, wherein the first and second lower fastener bosses each receive a lower fastener when the first and second bowl liner sections are in the assembled condition.

7. A bowl liner for use in a cone crusher, comprising:

a first bowl liner section having an inner surface, an outer surface, a first end extending between the inner and outer surface and a second end extending between the inner and outer surface;

a second bowl liner section having an inner surface, an outer surface, a first end extending between the inner and outer surface and a second end extending between the inner and outer surface, wherein the first end of the second bowl liner is in contact with the second end of the first bowl liner along a first vertical joint and the second end of the second bowl liner is in contact with the first end of the first bowl liner along a second vertical joint when the first and second bowl liners are in an assembled condition to define the bowl liner, wherein the first end of both the first bowl liner section and the second bowl liner section includes a wear relief area extending inwardly from the inner surface, wherein the wear relief creates a gap between the first end and the second end when the first and second bowl liner sections are in the assembled conditions.

8. A cone crusher for crushing rock, comprising:

a stationary bowl;

a head positioned within the stationary bowl and movable eccentrically relative to the stationary bowl; and a two-piece bowl liner detachably mounted to the stationary bowl, wherein the two-piece bowl liner is formed from a first bowl liner section joined to a second bowl liner section along a pair of vertical bowl liner joints wherein the first and second bowl liner sections each include a first end and a second end, wherein the first end of each of the first and second bowl liner sections includes a series of key slots integrally formed with the bowl liner section and the second end of each of the first and second bowl liner sections includes a series of protruding axial keys integrally formed with the bowl liner section, wherein the first end of the second bowl liner is in contact with the second end of the first bowl liner along one of the vertical bowl liner joints and the second end of the second bowl liner is in contact with the first end of the first bowl liner along the other vertical bowl liner joint when the first and second bowl liner sections are in an assembled condition to define the bowl liner, wherein the series of key slots interact with the series of protruding axial keys to restrict axial movement of the first and second bowl liner sections relative to each other when in the assembled condition.

9. The cone crusher of claim 8 wherein the bowl liner includes a pair of upper fasteners each positioned to hold the first and second bowl liner sections in the assembled condition.

10. A cone crusher for crushing rock, comprising:

a stationary bowl;

a head positioned within the stationary bowl and movable eccentrically relative to the stationary bowl; and a two-piece bowl liner detachably mounted to the stationary bowl, wherein the two-piece bowl liner is formed from a first bowl liner section joined to a second bowl liner section along a pair of vertical bowl liner joints, wherein each of the first and second bowl liner sections includes a first upper fastener boss and a second upper fastener boss, wherein the first and second upper fastener bosses each include one of a key slot and a radial key such that the key slots and radial keys interact with each other to limit the radial movement between the first and second bowl liner sections.

11. A bowl liner for use in a cone crusher, comprising:

a pair of identical first and second bowl liner sections, each of the first and second bowl liner sections including a first vertical end and a second vertical end, wherein the first end of the first bowl liner section is in contact with the second end of the second bowl liner section and the first end of the second bowl liner section is in contact with the second end of the first bowl liner section when the first and second bowl liner sections are in the assembled condition to define the bowl liner, wherein the first end includes a series of key slots integrally formed with the bowl liner section and the second end includes a series of protruding axial keys integrally formed with the bowl liner section, wherein the series of protruding axial keys are received in the key slots to restrict the axial movement of the first and second bowl liner sections when in the assembled condition.

12. A bowl liner for use in a cone crusher, comprising:

a pair of identical first and second bowl liner sections, each of the first and second bowl liner sections including a first vertical end and a second vertical end, wherein the first end of the first bowl liner section is in contact with the second end of the second bowl liner section and the first end of the second bowl liner section is in contact with the second end of the first bowl liner section when the first and second bowl liner sections are in the assembled condition to define the bowl liner, wherein each of the first and second bowl liner sections includes a first upper fastener boss and a second upper fastener boss, wherein the first upper fastener boss includes a key slot and the second upper fastener boss includes a protruding radial key, wherein the key slot receives the radial key when the first and second bowl liner sections are in the assembled condition such that the interaction between the key slot and radial key restrict the radial movement of the first and second bowl liner sections relative to each other.

* * * * *